US005921180A

United States Patent [19]

Lee

[11] Patent Number: 5,921,180

[45] Date of Patent: Jul. 13, 1999

[54] LABEL STAMPER WITH TAPE LOADING MEANS, GUIDE MEANS, HOLDING MEANS, STAMPING MEANS, AND REPLACEABLE CARTRIDGE

[76] Inventor: Duck Hee Lee, 840-14 Bangbae-Dong, Seocho-ku, Seoul, Rep. of Korea

[21] Appl. No.: 09/017,506

[22] Filed: Feb. 2, 1998

[30] Foreign Application Priority Data

| | | | |
|---|---|---|---|
| Feb. 5, 1997 | [KR] | Rep. of Korea | 97-1731 |
| Feb. 6, 1997 | [KR] | Rep. of Korea | 97-1813 |
| Feb. 14, 1997 | [KR] | Rep. of Korea | 97-2278 |
| Feb. 18, 1997 | [KR] | Rep. of Korea | 97-2445 |
| Feb. 18, 1997 | [KR] | Rep. of Korea | 97-2446 |

[51] Int. Cl.[6] ..... B41F 1/08

[52] U.S. Cl. ..... 101/288; 101/45

[58] Field of Search ..... 101/45, 288, 93.02; 156/284

[56] References Cited

U.S. PATENT DOCUMENTS

| | | | |
|---|---|---|---|
| 4,699,685 | 10/1987 | Sato | 156/384 |
| 4,813,355 | 3/1989 | Stork | 101/288 |
| 4,853,068 | 8/1989 | Becker | 156/384 |
| 4,871,269 | 10/1989 | Murata | 400/88 |
| 5,009,739 | 4/1991 | Goodwin et al. | 156/384 |
| 5,258,090 | 11/1993 | Becker et al. | 156/384 |
| 5,655,450 | 8/1997 | Hermannn | 10/288 |

FOREIGN PATENT DOCUMENTS

| | | |
|---|---|---|
| 318 | 3/1988 | Rep. of Korea . |
| 1177 | 2/1990 | Rep. of Korea . |
| 1206 | 4/1990 | Rep. of Korea . |
| 2 193 161 | 2/1988 | United Kingdom . |

*Primary Examiner*—Edgar Burr
*Assistant Examiner*—Dave A. Ghatt
*Attorney, Agent, or Firm*—King and Schickli

[57] ABSTRACT

An improved label stamper which is capable of stamping prices on labels attached on a tape so as to attach the stamped labels on commodities is disclosed. A tape loading mechanism of the label stamper is constituted such that a loading case goes in and out of the machine by functions of a pair of folding and extending legs, so that the label tape can be loaded in a convenient manner. A guide is constituted such that a front plate and a rear plate are fastened across a narrow gap, and this gap forms a guide channel. In a holding mechanism, a push plate is disposed facing toward a base plate, and the push plate interlocks a movable lever to the loading case. Thus, if the tape is inserted into the guide channel, the tape is automatically press-held to the base plate. In a stamping mechanism, a selecting hole of a selecting wheel for driving a stamping belt is provided with a recess and a triangular protuberance. Thus two selecting wheels will never be engaged together, and fingers of a selecting bar are accurately coupled to the selected wheel. In a carrying mechanism, carrying rollers are provided in the form of a cartridge, and this cartridge is replaceably accommodated within a cartridge compartment. This improves the compactness and the performance of the label stamper, and the cartridge can be conveniently replaced.

17 Claims, 15 Drawing Sheets

LABEL STAMPER WITH TAPE LOADING MEANS, GUIDE MEANS, HOLDING MEANS, STAMPING MEANS, AND REPLACEABLE CARTRIDGE

BACKGROUND OF THE INVENTION

1. Field of the Invention

The present invention relates to an improved label stamper which is capable of stamping prices on labels attached on a tape so as to attach the stamped labels on commodities.

2. Description of the Prior Art

Generally, the label stamper is a machine which stamps prices on labels to attach them on commodities. The label stamper has a complicated structure.

That is, the label stamper includes: (1) a means for loading a label tape into a case; (2) a guide means for guiding the loaded label tape toward a stamper; (3) a holding means for firmly holding the guided label tape onto the stamper; (4) a stamping means for stamping prices on labels; and (5) a carrying means for attaching the stamped labels on commodities, and for pulling the empty tape to discharge it to the outside. These means have various structures respectively, and the constitution of the structures of the different means decide the superiority of the label stamper.

The prior art for the present invention will be described below.

(1) One example of the loading means for loading the label tape of the label stamper is disclosed in Japanese Utility Model Laid-open No. Sho-59-3814 (dated Jan. 11, 1984). In this tape loading device, a tape roll is inserted into a narrow loading chamber of the label stamper.

In this prior art, the tape roll is inserted into the narrow loading chamber, and a supporting shaft is fitted into a retainer. This procedure is very complicated, and inconvenient. Further, it frequently happens that the tape is not smoothly loosened.

Other loading means are known, but they are also inconvenient when, for example, within a crowded store it is desired to replace the tape roll quickly.

(2) One example of the guide means for guiding the label tape is disclosed in Korean Utility Model Publication No. 90-1370. In this guide means, a guide hole is formed vertically from the top of the stamping machine like a tunnel. The end of the label tape is inserted into the tunnel shaped guide hole from above to pass through the bottom of the machine. Then the tape is carried by a carrying roller.

In this prior art, the label tape is liable to be bent or folded within the tunnel, and therefore, it is very inconvenient to insert the label tape.

(3) Examples of the holding means for holding the tape are disclosed in Korean Patent Publication No. 82-1815 (dated Oct. 12, 1982) and Korean Patent application Laid-open No. 88-12449 (Nov. 26, 1988).

In these devices, a lower plate which is provided with a push plate can be opened and closed by means of a hinge.

Therefore, when inserting the tape into the guide hole, the lower plate is opened, then the tape is inserted into the guide hole, and then, the lower plate is closed, so that the push plate would push up the tape.

In these devices, each time when the label tape is replaced, the lower plate has to be opened and closed, this being a troublesome task. Further, their structure is very complicated, and therefore, the manufacturing cost becomes high, as well as being liable to disorders. Further, the operation procedure for the stamping machine is very complicated.

(4) The important matter in the label stamping is the shifting of the character blocks. One example of the stamping means is disclosed in Korean Utility Model Publication No. 83-2593 (dated Dec. 7, 1983), Korean Patent Application Laid-open No. 88-308 (dated Mar. 24, 1988), and Korean Patent Publication No. 80-1096 (dated Oct. 6, 1980). Further, other examples are known.

In one of these devices, the selecting wheel has to be rotated manually, and therefore, the selecting wheel is very inconvenient.

In another, the selecting wheel is rotated by means of a selecting bar. When shifting the selecting bar, the selecting bar is engaged between two selecting wheels, with the result that the two selecting wheels are rotated simultaneously. Because of this, the selection of character blocks becomes inconvenient.

(5) Examples of the carrying means for carrying the tape of the label stamper are disclosed in Japanese Patent Publication No. Sho-53-43038 (dated Nov. 16, 1978), Japanese Utility Model Laid-open No. 83-139 (dated Mar. 25, 1983), and Korean Utility Model Publication No. 90-3053 (dated Apr. 12, 1990).

In these devices, the tape carrying roller is secured to the machine by means of supporting shafts, and therefore, the assembling procedure is very complicated. Further, they cannot maintain balance with the other assembling procedure of the other components, and therefore, the production line is stopped frequently, with the result that the production cost is increased. Further, even if the carrying roller is damaged during the use, its replacement is almost impossible, with the result that the whole stamping machine becomes useless.

SUMMARY OF THE INVENTION

The present invention is intended to overcome the above described disadvantages of the conventional techniques.

Therefore it is an object of the present invention to provide a label stamper for use in a store for stamping prices on commodities, in which the functions are much progressed and improved.

The tape loading means of the label stamper according to the present invention is constituted such that a loading case goes in and out of the machine by functions of a pair of folding and extending legs, so that the label tape can be loaded in a convenient manner.

The guide means for the label tape according to the present invention is constituted such that a front plate and a rear plate are fastened across a narrow gap, and in this gap, a guide channel is formed. A side of this channel is open, and the tape is inserted into the open portion of the channel in a convenient and speedy manner.

The holding means of the label stamper according to the present invention is constituted such that a push plate is disposed facing toward a base plate, and the push plate interlocks a movable lever to the loading case. Thus, if the tape is inserted into the guide channel, the tape is automatically press-held to the base plate. During the carriage of the tape, the tape is carried by being lightly pressed upon the base plate.

The stamping means of the label stamper according to the present invention is constituted as follows. That is, a selecting hole of a selecting wheel for driving a stamping belt is provided with a recess and a triangular protuberance. Thus two selecting wheels will never be engaged simultaneously, and fingers of a selecting bar are accurately coupled to the selected wheel. Therefore, the desired characters can be accurately and conveniently selected.

The stamping means includes an ink roller of a known type and an interlocking mechanism for the ink roller. Thus automatically, ink is spread on the character blocks, with the result that the characters are clearly stamped on the labels.

In the carrying means for carrying the label tape, the carrying rollers for the tape are provided in the form of a cartridge, and this cartridge is replaceably accommodated within a cartridge compartment. This improves the compactness and the performance of the label stamper, and the cartridge can be conveniently replaced.

Therefore, the label stamper according to the present invention shows improved functions, with the result that the label stamper is not liable to disorders, and its use is convenient.

BRIEF DESCRIPTION OF THE DRAWINGS

The above objects and other advantages of the present invention will become more apparent by describing in detail the preferred embodiment of the present invention with reference to the attached drawings in which:

FIG. 1-1 is a perspective view showing the tape loading means 100 of the label stamper of the present invention, with the side plate removed;

FIG. 1-2 is a side view showing the loaded state of the tape roll;

FIG. 1-3 is a frontal view showing the tape loading means partly cut off;

FIG. 2-1 is a perspective view showing the guide channel means 200 for the label tape of the present invention;

FIG. 2-2 is a perspective view showing the guide means in detail, with the side plate removed;

FIG. 2-3 is a side view showing the label tape inserted into the guide channel of the label stamper according to the present invention;

FIG. 3-1 is an exploded perspective view showing the holding means 300 for holding the label tape of the present invention;

FIG. 3-2 is a side view showing the critical portion of the holding means;

FIG. 3-3 illustrates the operating state of the label tape;

FIG. 4-1 is an exploded perspective view showing the stamping means 400 according to the present invention;

FIG. 4-2 is an enlarged side view of the stamping means;

FIG. 4-2*a* is a frontal view of the selecting wheel;

FIG. 4-3 is an enlarged sectional view showing the shifting of the selecting bar in the selecting wheel according to the present invention;

FIG. 4-4 is an enlarged sectional view showing a selection-contact state of the selecting bar together with the selecting wheel;

FIG. 5-1 is an exploded perspective view showing the tape carrying means 500 of the label stamper according to the present invention;

FIG. 5-2 is an exploded perspective view of the tape carrying cartridge according to the present invention;

FIG. 5-3 is a perspective view of the tape carrying cartridge;

FIG. 5-4 is a longitudinal sectional view of the tape carrying cartridge;

FIG. 5-5 is a side sectional view taken along a line A—A of FIG. 5-4;

FIG. 5-6 is a side sectional view taken along a line B—B of FIG. 5-4; and FIG. 5-7 illustrates the assembled state of the tape carrying cartridge according to the present invention.

DETAILED DESCRIPTION OF THE PREFERRED EMBODIMENTS

Figure 1:
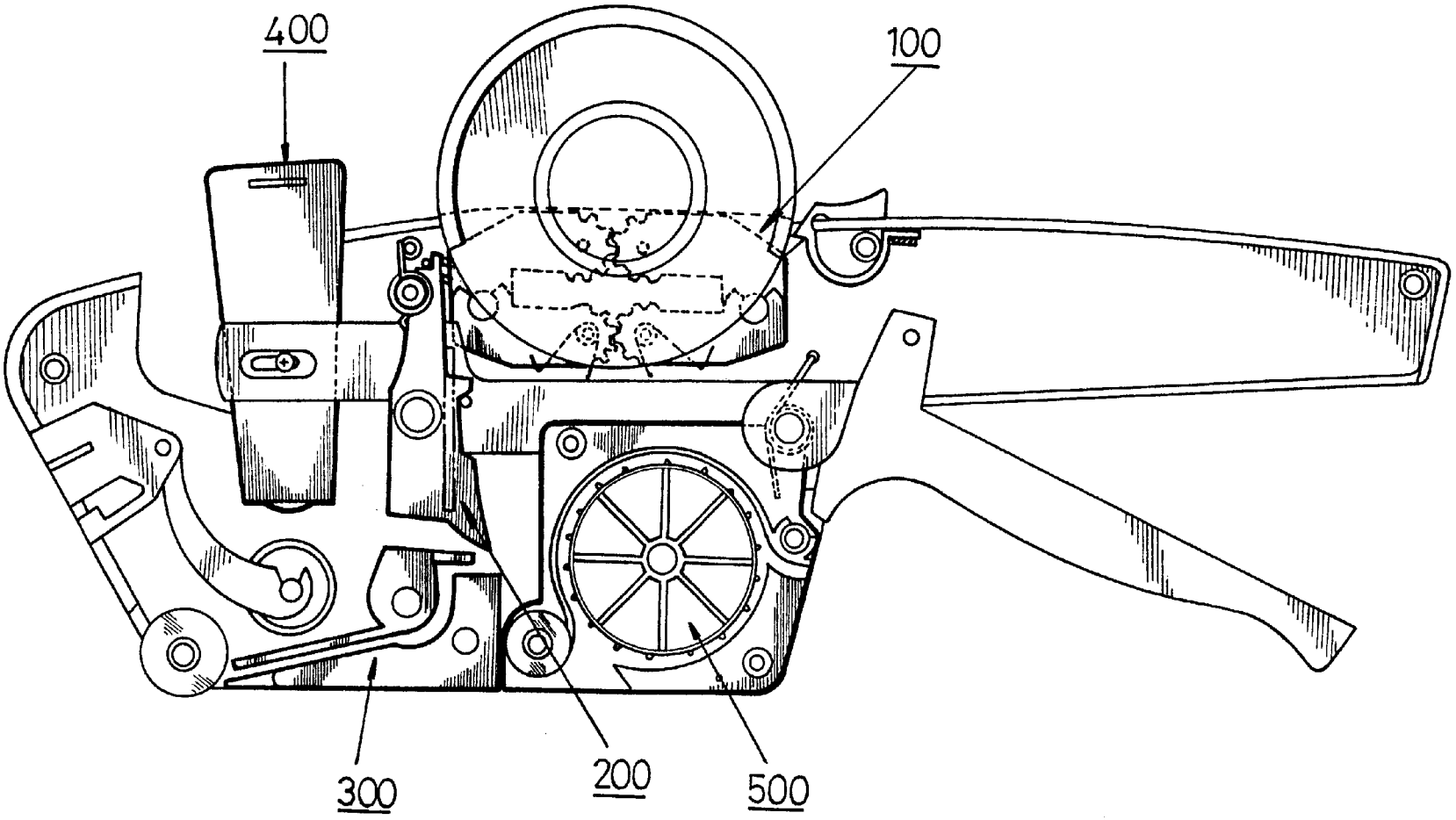
FIG. 1 illustrates the total constitution of the label stamper of the present invention, with the side plate removed.
Figure 1:
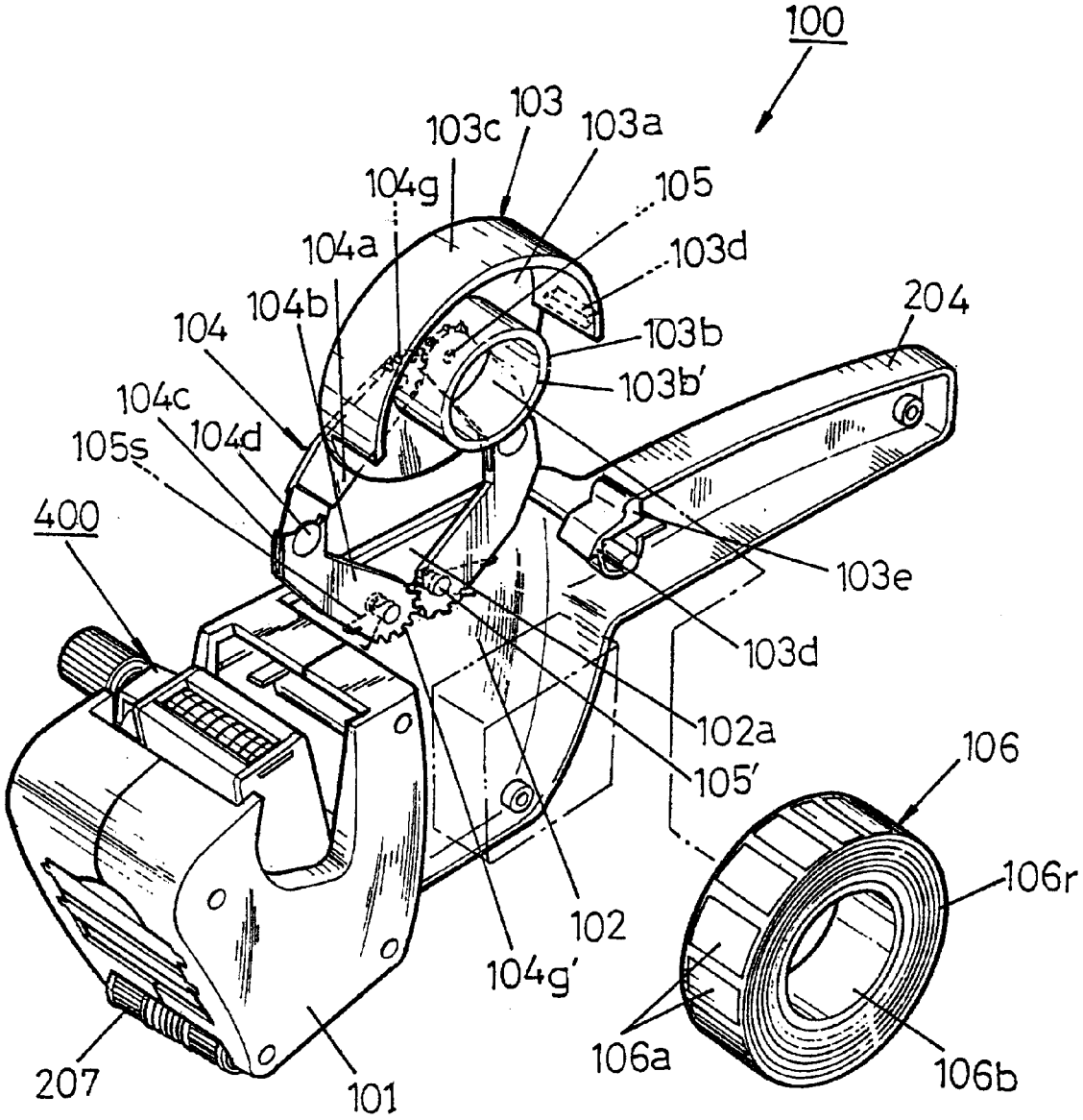

As shown in FIG. 1, the label stamper according to the present invention includes:

a label tape loading means 100 for loading a label tape in a convenient manner;

a label guide means 200 with its side portion open;

a tape holding means 300 for automatically press-holding the label tape after its insertion into a guide channel;

a character selecting means 400 for selecting characters in an accurate and easy manner; and a cartridge type tape carrying means 500 for attaching stamped labels onto commodities, and for pulling out the empty tape to the outside of the label stamper.

The above described function means 100, 200, 300, 400 and 500 have improved structures compared with the conventional means.

Now the function means will be described as to their constitutions and actuations.

Figures 1, 2:
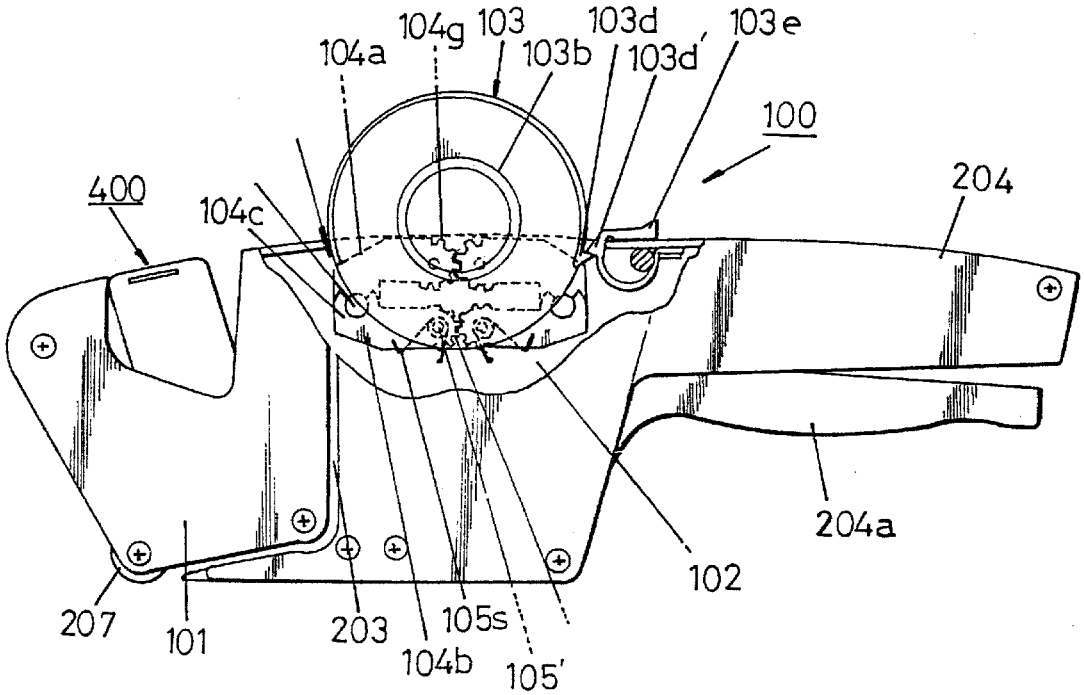
Figures 1, 2, 3:
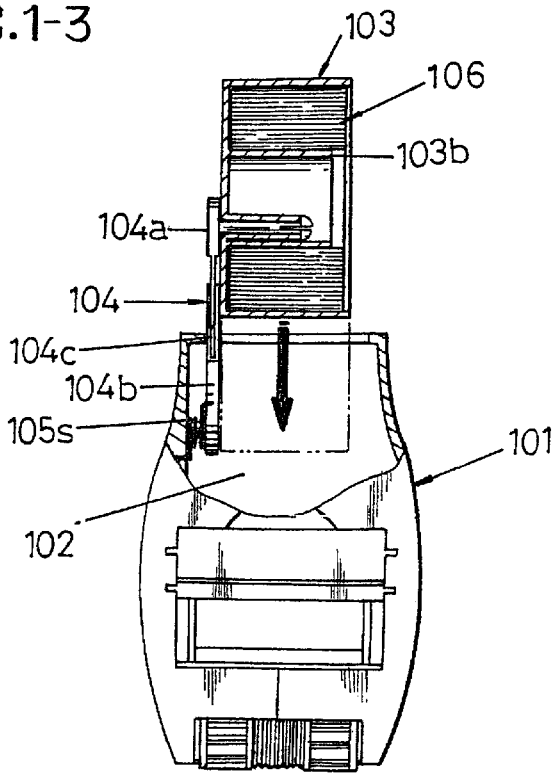
Figures 1, 2:
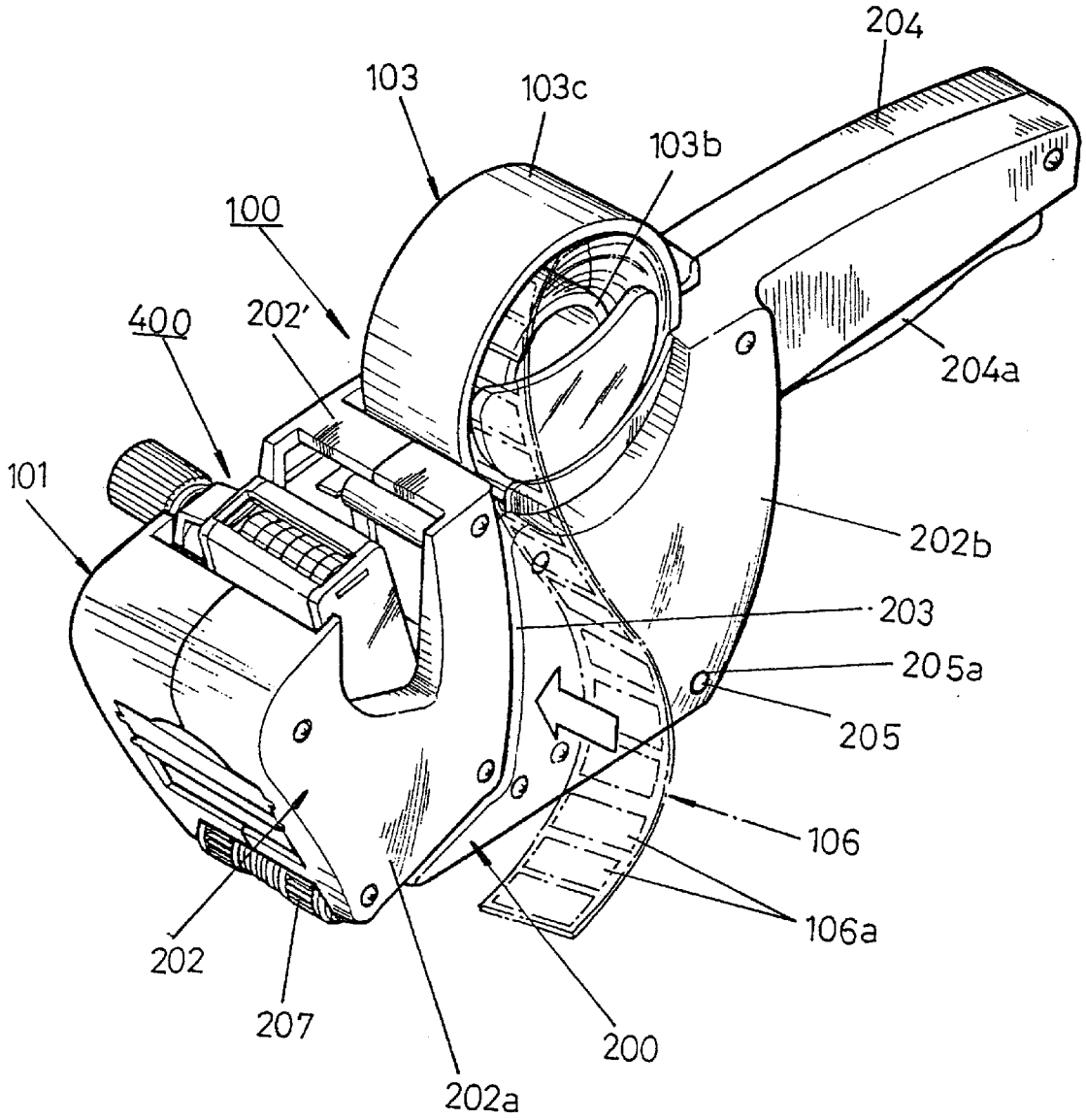
Figure 2:
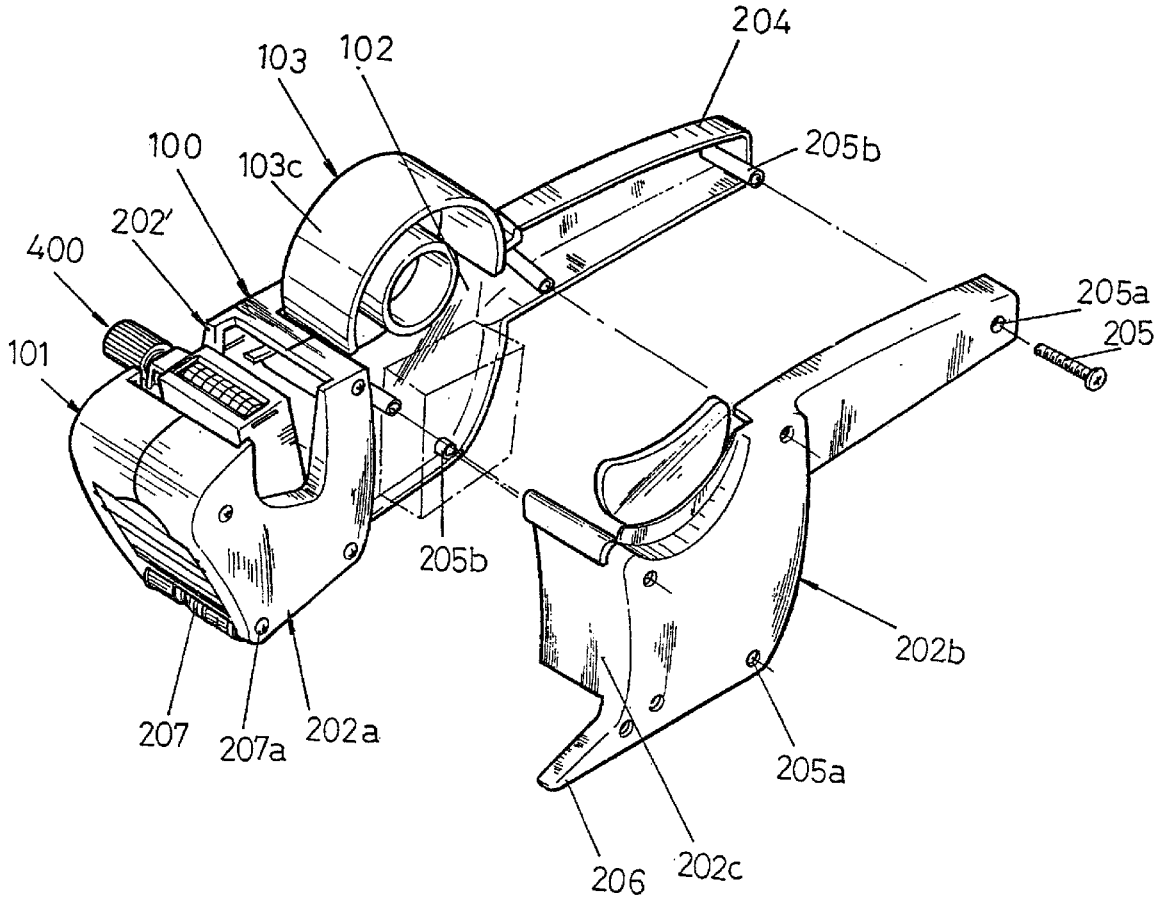
Figures 2, 3:
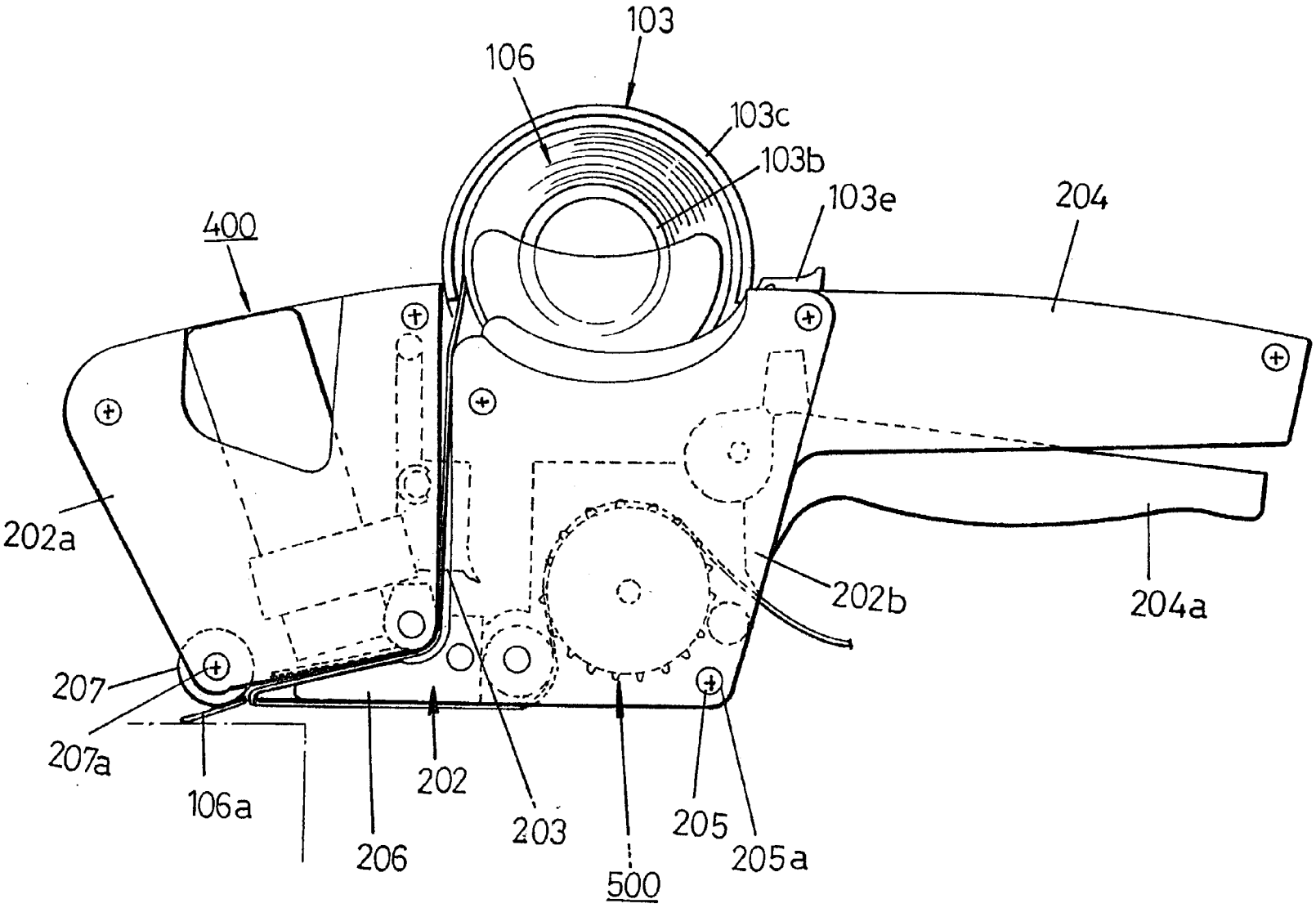
Figures 1, 3:
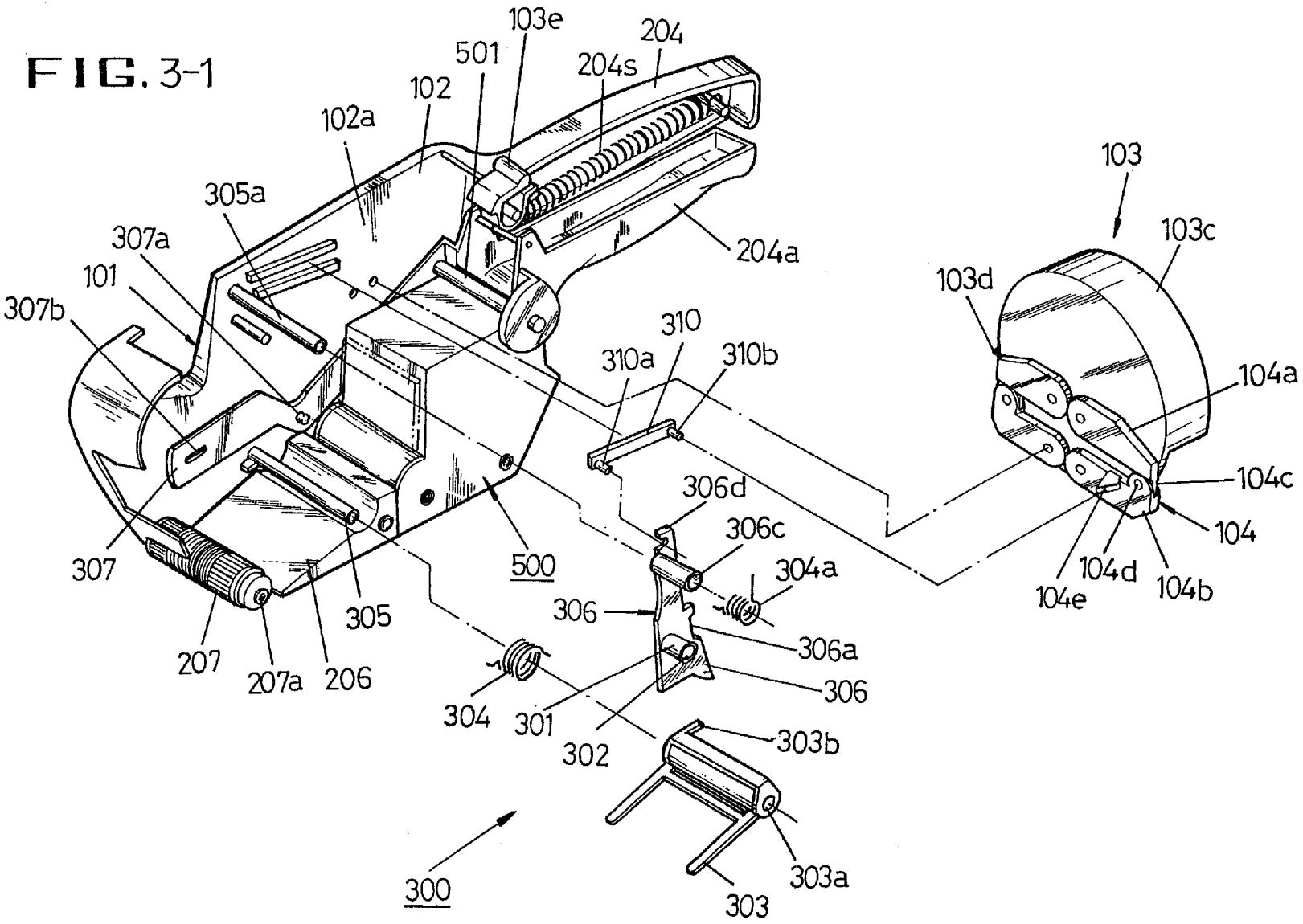
Figure 3:
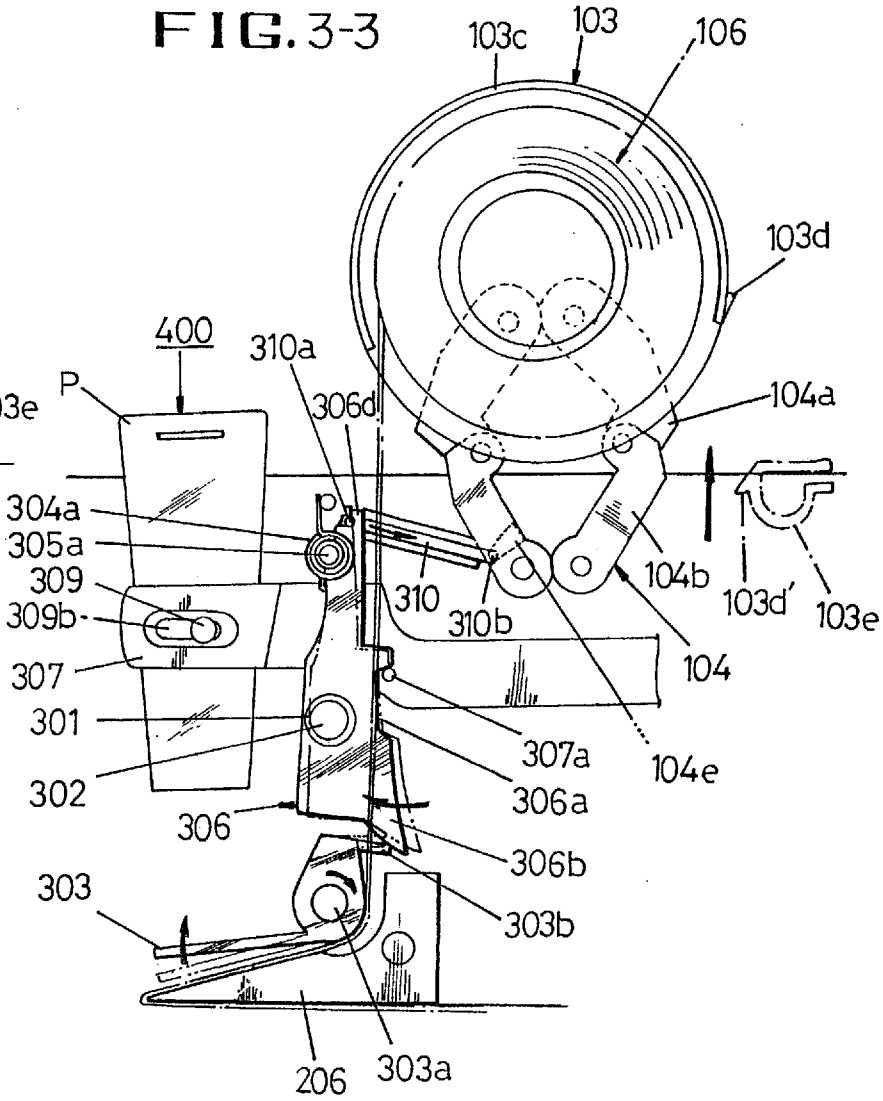
Figures 2, 3:
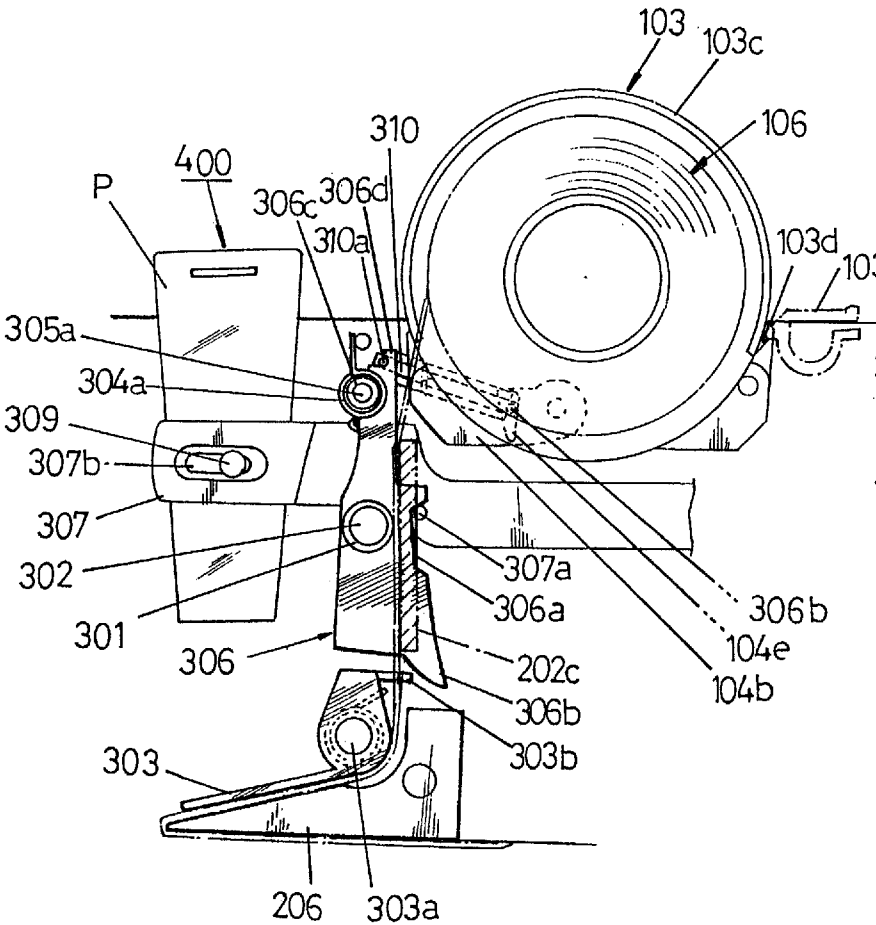

FIG. 1-1 is a perspective view showing the tape loading means 100 of the label stamper of the present invention, with the side plate removed. FIG. 1-2 is a side view showing the loaded state of the tape roll. FIG. 1-3 is a longitudinal sectional view of it.

As shown in FIG. 1-1, a tape loading compartment 102 is formed at a middle of a main body 101. The tape loading compartment 102 is surrounded by side plates 102*a*, and its top is open. On one of the side plates 102*a* of the tape loading compartment 102, there are disposed a pair of joint type legs 104 supported by shafts 105 and 105'. A loading case 103 is disposed above the legs 104. A torsion spring 105*s* is installed on each of the legs 104, so that the legs 104 can be extended.

In the loading case 103, a shaft 103*b* projects at the middle of the side plate 103*a*. Another side of the loading case 103 is open. The outer end of the shaft 103*b* forms a free end 103*b*'. A plurality of labels 106*a* are attached aligned in one straight line on a tape 106, this being a known type. A shaft hole 106*b* of a tape roll 106*r* on which the tape 106 is wound is fitted to the shaft 103*b* from the free end 103*b*', thereby loading the tape roll into the loading case 103.

An arcuate cover 103*c* is disposed above the loading case 103, and the cover 103*c* is provided with an engaging step 103*d*. The loading compartment 102 is provided with a locking lever 103*e* having an engaging step 103*d*', so that it can be coupled to the engaging step 103*d* of the cover 103*c*.

As shown in FIG. 1-2, if the case 103 is pressed down into the loading compartment 102, then the engaging step 103*d* of the cover 103*c* is coupled to the engaging step 103*d*' of the locking lever 103*e* so as to be locked.

Since the engaging steps 103*d* and 103*d*' are coupled together, and owing to the elasticity of the locking lever 103*e*, the locking lever 103*e* is not released unless it is manually released.

The cover 103*c* which is disposed above the loading case 103 arcuately covers the loading compartment 102, thereby protecting the tape. The lower half portion of the loading case 103 is inserted into the loading compartment 102, while the upper half portion of the loading case 103 is exposed above the main body. Therefore, the remaining amount of the tape can be confirmed visually. Although a part of the tape roll 106*b* is exposed to the outside of the loading compartment 102, the tape roll does not depart from the loading compartment.

Each of the legs 104 of the loading case 103 consists of an upper leg 104*a* and a lower leg 104*b*, these two being connected by a shaft 104*d* of a joint 104*c*. That is, the upper and lower legs are connected by a hinge, so that the legs 104 can be folded and extended.

The upper and lower portions of the upper and lower legs 104*a* and 104*b* are provided with teeth 104*g* and 104*g*' like gears, and these teeth are meshed together. Owing to the mesh of the teeth, the upper and lower legs 104*a* and 104*b* of the two legs 104 actuate at the same angle, so that the loading case can move vertically up and down. A torsion spring 105*s* is installed on each of the shafts 105' of the legs 104, thereby providing elastic forces to the legs 104.

Therefore, if the locking lever 103*e* is pulled to a side to release the two engaged engaging steps 103*d* and 103*d*', then the folded legs 104 extend upward as shown in Table FIG. 1-3. Under this condition, owing to the extension of the legs 104, the loading case 103 which has been accommodated within the loading compartment 102 protrudes upward. When the loading case is thus protruded, the tape roll 106*r* can be loaded in a convenient manner.

This loading device is improved compared with the conventional ones, while its aesthetic appearance is nice, as well as being convenient to use.

FIG. 2-1 is a perspective view showing the guide channel means 200 for the label tape of the present invention. FIG. 2-2 is a perspective view showing the guide means in detail, with the side plate removed. FIG. 2-3 is a side view showing the label tape inserted into the guide channel of the label stamper according to the present invention.

As shown in FIG. 2-1, a side plate 202 of the main body 101 is divided into a front side plate 202*a* and a rear side plate 202*b*. These two side plates 202*a* and 202*b* are attached onto a side of the main body 101 through screws 205 and screw holes 205*a* and 205*b*, leaving a small gap between them. This gap is a guide channel 203 through which the tape runs.

As shown in FIG. 2-2, a guide plate 202*c* is formed on the front end of the rear plate 202*b*, and this guide plate 202*c* forms a side wall of the guide channel 203. In the drawing, the guide channel 203 is bent in an L shape. However, it will not be limited to the drawn shape, but can be modified to any other shape.

In accordance with the shape of the guide channel 203, the contours of the front and rear plates 202*a* and 202*b* are varied. Further, the guide channel 203 is defined by the front and rear plates 202*a* and 202*b*. This channel 203 is open, and this feature is that which is different from the conventional ones.

Therefore, as shown in FIG. 2-3, the tape 106 which is accommodated within the loading room 102 can be inserted into the guide channel 203 through the open portion. This is an improved feature compared with the conventional ones in which the tape is inserted into a guide hole.

The guide channel 203 guides the label tape 106 under a stamp P, so that the labels can be stamped.

At the lower portion of the guide channel 203, there is formed a base plate 206 which is formed on the rear side plate 202*b* (refer to FIG. 3-1).

The base plate 206 is a pad for supporting the stamping. Facing to a sharp edge of the base plate 206, there is an attaching roller 207 which is rotatably secured on the lower end of the front side plate 202*a*.

Accordingly, if the tape is pulled by the tape carrying means (which is to be described later), the stamped labels 106*a* are detached from the tape 106 at the sharp edge of the base plate 206 due to the bent running of the tape. Then the detached labels are attached onto the commodities owing to the pressing of the attaching roller 207. That is, if the handle 204 is grasped, and if the attaching roller 207 is rubbed onto the commodity, then the label is attached onto the commodity.

FIG. 3-1 is an exploded perspective view showing the holding means 300 for the label tape of the present invention. FIG. 3-2 is a side view showing the holding means. FIG. 3-3 illustrates the operating state of the label tape.

The tape holding means 300 is a device which lightly presses the label tape when stamping it, so that the label tape would not be oscillated.

As shown in FIG. 3-1, the base plate 206 faces the stamping device P in an inclined posture. Above the base plate 206, there is a push plate 303 which is installed movably up and down by means of a retaining portion 303*a* and supporting shaft 305. Owing to the force of the coil spring 304, the push plate 303 presses the base plate 206, so that the tape 106 would be secured on the base plate 206.

About the middle of the side plate 102*a* of the main body 101, there is installed an interlocking lever 306 which is coupled to a shaft 305*a* by means of a shaft hole 306*c* together with a coil spring 304*a*. An actuation lever 307 which is installed on the main body 101 contacts with a recessed cam portion 306*a* of the lever 306. When the actuation lever 307 is actuated up and down by means of a manual lever 204*a*, the interlocking lever 306 moves up and down owing to the sliding of a protuberance 307*a*.

As shown in FIG. 3-2, a roller 301 which is installed on a shaft 302 of the lever 306 presses or releases the label tape 106 which has been inserted into the guide channel 203. Therefore, when the tape runs, an excessive loosening of the tape is prevented.

As shown in FIG. 3-3, a connection bar 310 is connected to a connection groove 104*e* and a connection groove 306*d* by means of shafts 310*a* and 310*b*.

Therefore, when the loading case 103 is inserted into the loading compartment 102 like in the FIG. 3-2, the connection bar 310 pushes the upper portion of the interlocking lever 306 to the left, and therefore, the lower portion 306*b* of the lever 306 departs from the lever 303*b* of the push plate 303.

Therefore, owing to the elastic force of the coil spring 304, the push plate 303 closely contacts to the base plate 206 to lightly press down the tape on the base plate 206. This prevents movements of the label tape during the stamping, so that the stamping can be made accurately.

Meanwhile, when the loading case 103 is protruded to the outside of the loading compartment 102 like in FIG. 3-3, the connection bar 310 is pulled to the right by the legs 104. Therefore, the lower portion 306*b* of the lever 306 moves to the left, and therefore, the lower portion 306*b* of the lever 306 presses down the lever 303*b* of the push plate 303, with the result that the push plate 303 departs from the base plate 206. Under this condition, the tape 106 can be easily inserted in between the push plate 303 and the base plate 206 during a replacement of the tape.

Figures 1, 4:
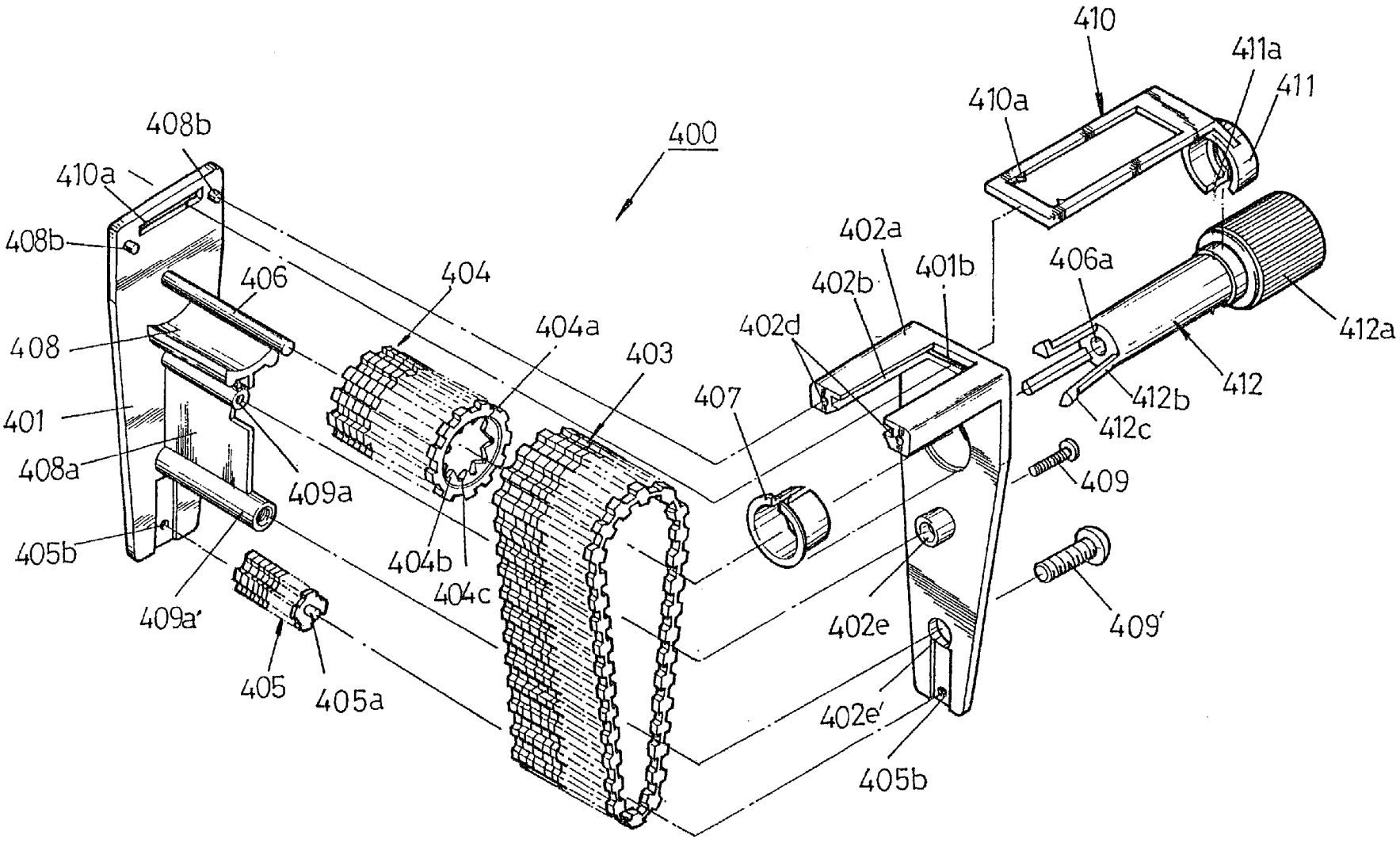
Figures 2, 4:
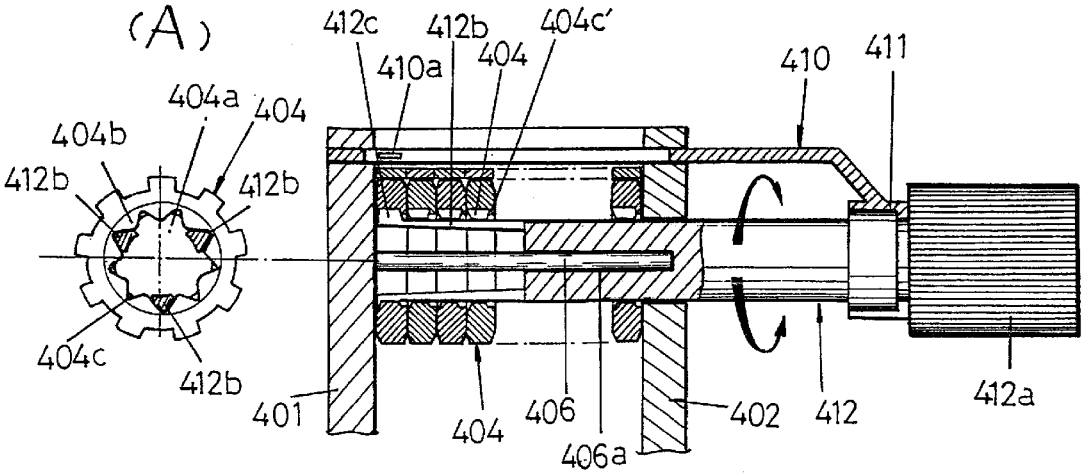
Figures 3, 4:
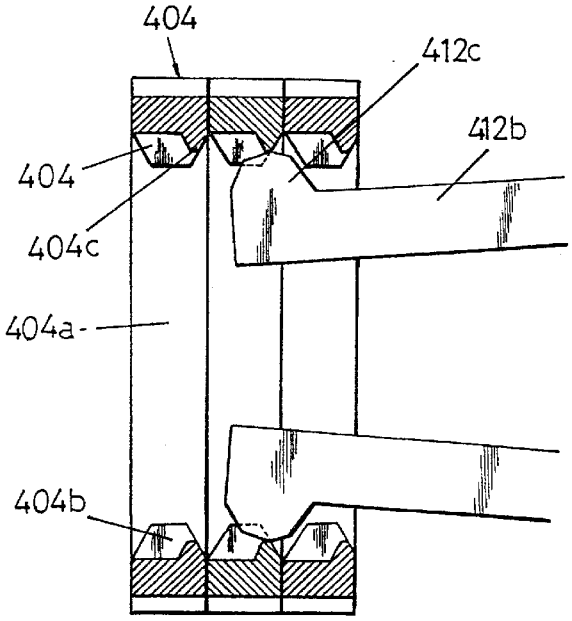
Figure 4:
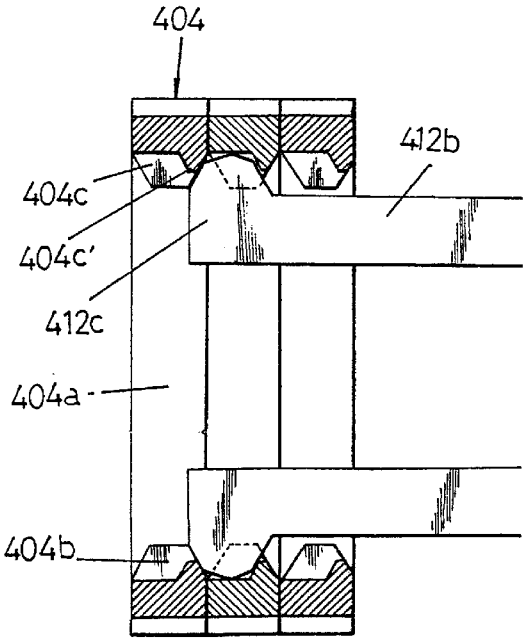

FIG. 4-1 is an exploded perspective view showing the main portion of the stamping means 400 according to the present invention. FIG. 4-2 is an enlarged side view of the stamping means. FIG. 4-3 is an enlarged sectional view showing the shifting of the selecting bar in the selecting wheel according to the present invention. FIG. 4-4 is an enlarged sectional view showing a selection-contact state of the selecting bar together with the selecting wheel.

The stamping means of the label stamper according to the present invention is capable of selecting and arranging the character blocks accurately and speedily.

As shown in FIGS. 1 and 3-2, the stamper P is generally installed on the front portion of the actuation lever 307 which is actuated by a hand lever 204*a*.

In this stamper P, two side plates 401 and 402 are assembled by means of fastening screws 409 and 409' and fastening holes 409*a*, 409*a*', 402*e* and 402*e*' of a supporting plate 408*a*. A guide plate 402*a* with a guide groove 402*b* formed thereon is formed on an end of the side plate 402. A coupling hole 402*d* which is formed on an end of the guide plate 402*a* is coupled to a coupling protuberance 408*b* of the side plate 401. A rectangular slider 410 is inserted into the guide groove 402*b* of the guide plate 402*a*, in such a manner that the slider 410 can slide through elongate guide holes 401*a* and 401*b* formed laterally on the upper portions of the side plates 401 and 402.

Further, on the upper portion of the side plate 401, there are formed a guide rod 406 and a gently curved retaining plate 408. A selecting wheel 404 having a plurality of selecting steps is fitted to the guide rod 406, and at the same time, is supported by the gently curved retaining plate 408. A stamping wheel 405 is installed between the two side plates 401 and 402 by means of a shaft 405*a* and shaft holes 405*b*. Surrounding the selecting wheel 404 and the stamping wheel 405, there is a character stamping belt 403 on which an index part (not shown in the drawing) and a numeral part (not shown in the drawing) are formed. An elastic grasping ring 411 which is formed on the slider 410 receives a selecting bar 412 together with a sleeve 407 through a cut portion 411*a*.

A handle 412*a* is formed on the rear portion of the selecting bar 412. A plurality of fingers 412*b* (3 in the drawing) having protuberances 412*c* are formed on the front portion of the selecting bar 412. The selecting bar 412 is inserted into the selecting hole 404*a* of the selecting wheel 404. Thus an indicating pin 410*a* of the slider 410 is set to the desired numeral of the numeral part of the stamping belt 403 by shifting the selecting bar 412 by holding the handle 412*a*.

The selecting hole 404*a* is provided with a plurality of ridges 404*b* and furrows 404*c*. As shown in FIG. 4-2*a*, the protuberances 412*c* of the fingers 412*c* of the selecting bar 412 are inserted into the furrows 404*c* of the selecting hole 404*a* so as to be clutched owing to the elasticity of the fingers.

Therefore, if the selecting wheel is rotated by turning the selecting bar 412 by grasping the handle 412*a*, the clutched selecting wheel is rotated, and the stamping belt 403 is also rotated. Thus the selected numeral is placed on the lower stamping wheel 405.

As shown in FIG. 4-4, a triangular protuberance 404*c*' is formed on each of the furrows 404*c* of the selecting hole 404*a* of the selecting wheel 404.

Thus when the selecting bar is shifted to the left and right by grasping the handle 412*a*, the fingers 412*b* are easily shifted and inserted into the furrows 404*c*. In a stationary state, the protuberances 412*c* of the fingers 412*b* are halted by the triangular protuberances 404*c*' so as to be engaged into the selecting hole 404*a* of the selecting wheel 404. Therefore, they cannot be coupled to an intermediate position. Accordingly, the character blocks can be accurately selected.

The guide rod 406 is inserted into the guide hole 406*a* of the selecting bar 412, and therefore, it moves straightly during the shifting manipulation. The stamping belt 403 is coupled to the selecting wheel 404 and the stamping wheel 405, and therefore, the characters (letters and numerals) can be arbitrarily selected to stamp prices.

Figures 1, 5:
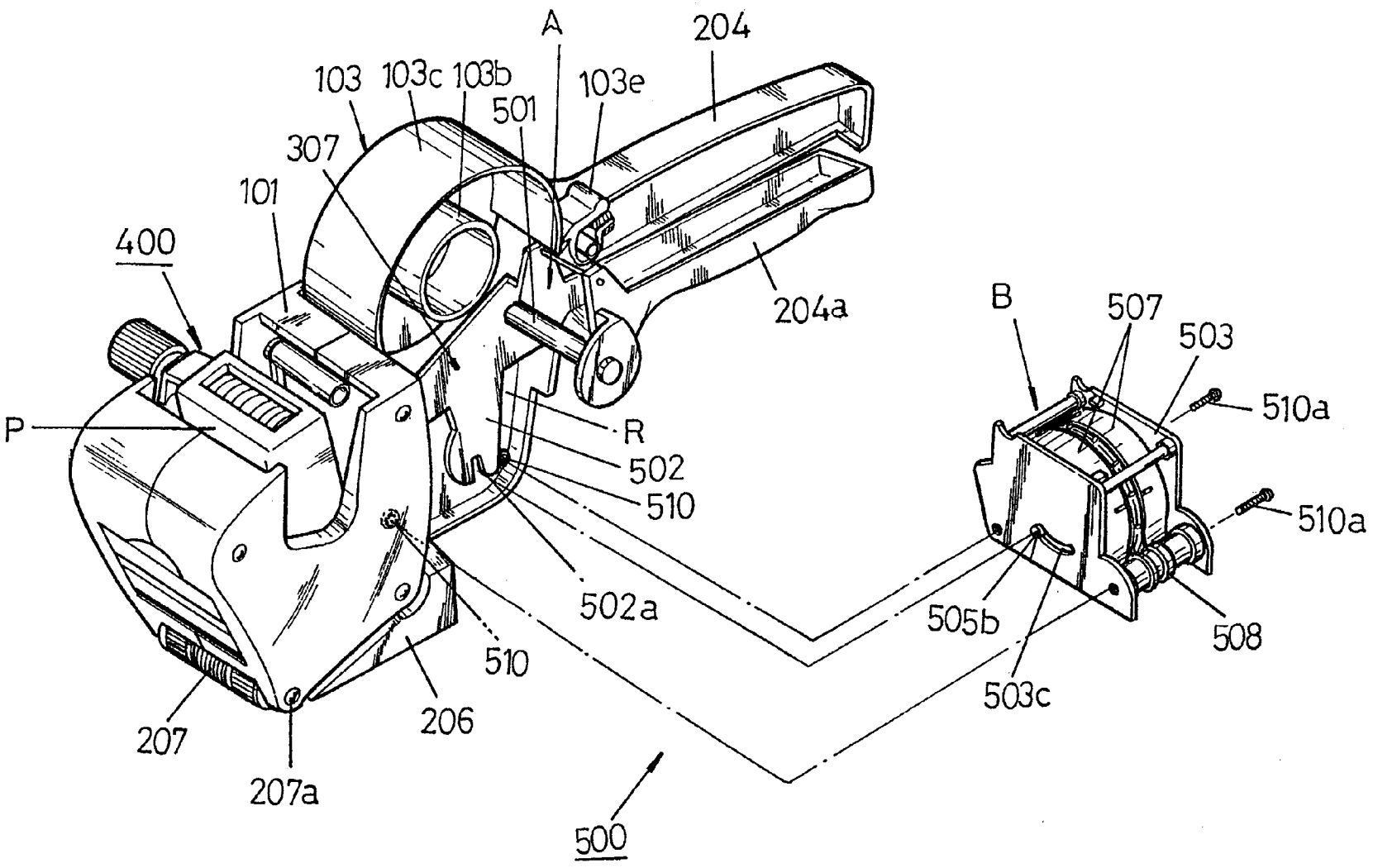
Figures 2, 5:
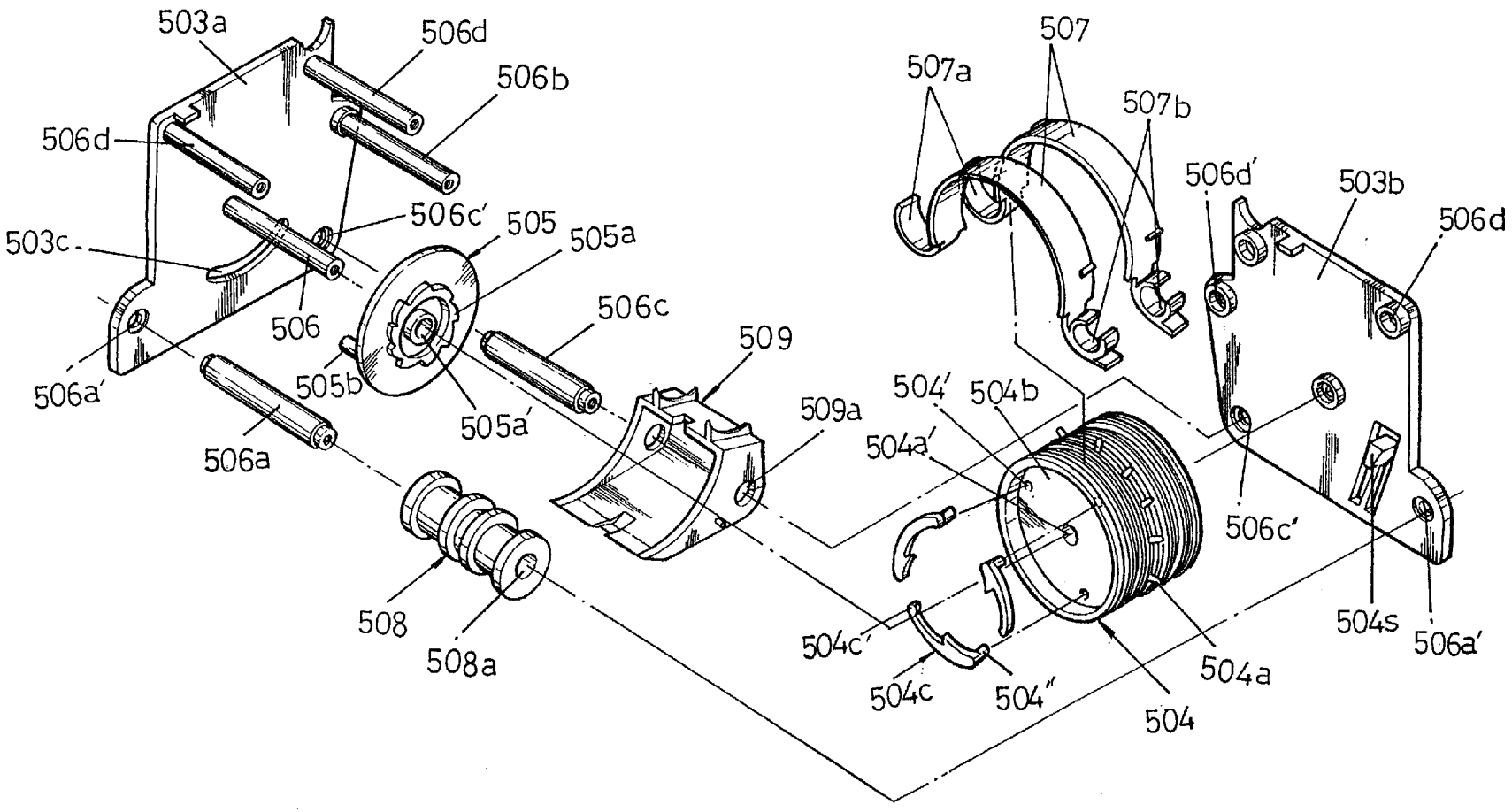
Figures 3, 5:
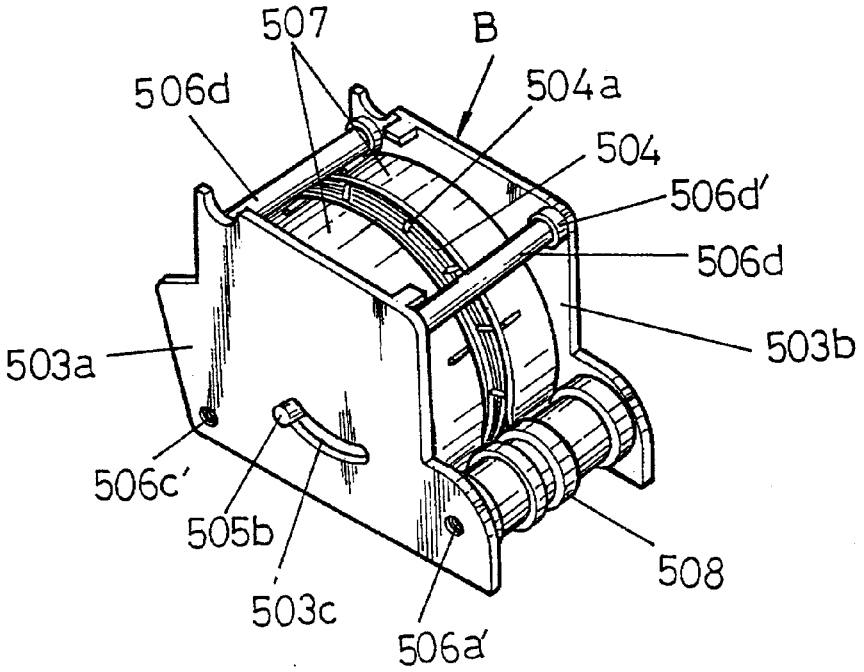
Figures 4, 5:
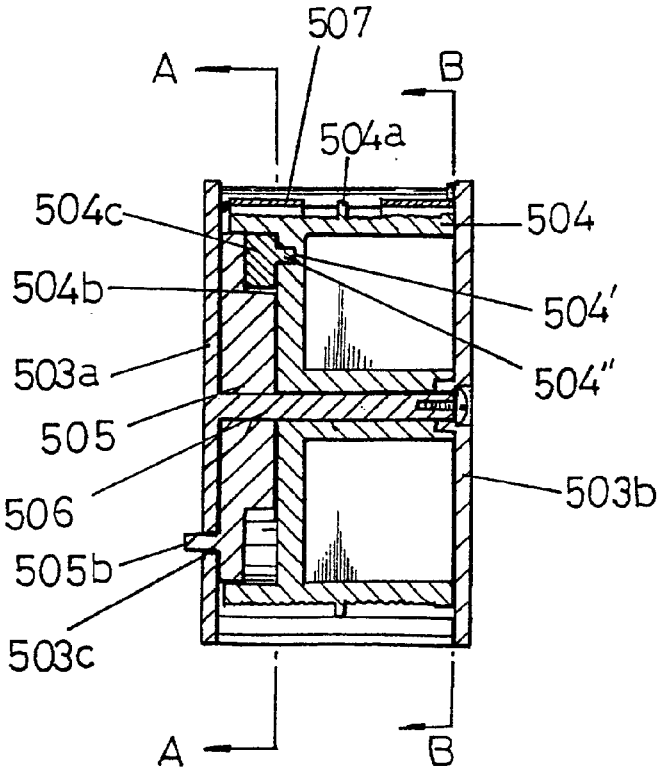
Figure 5:
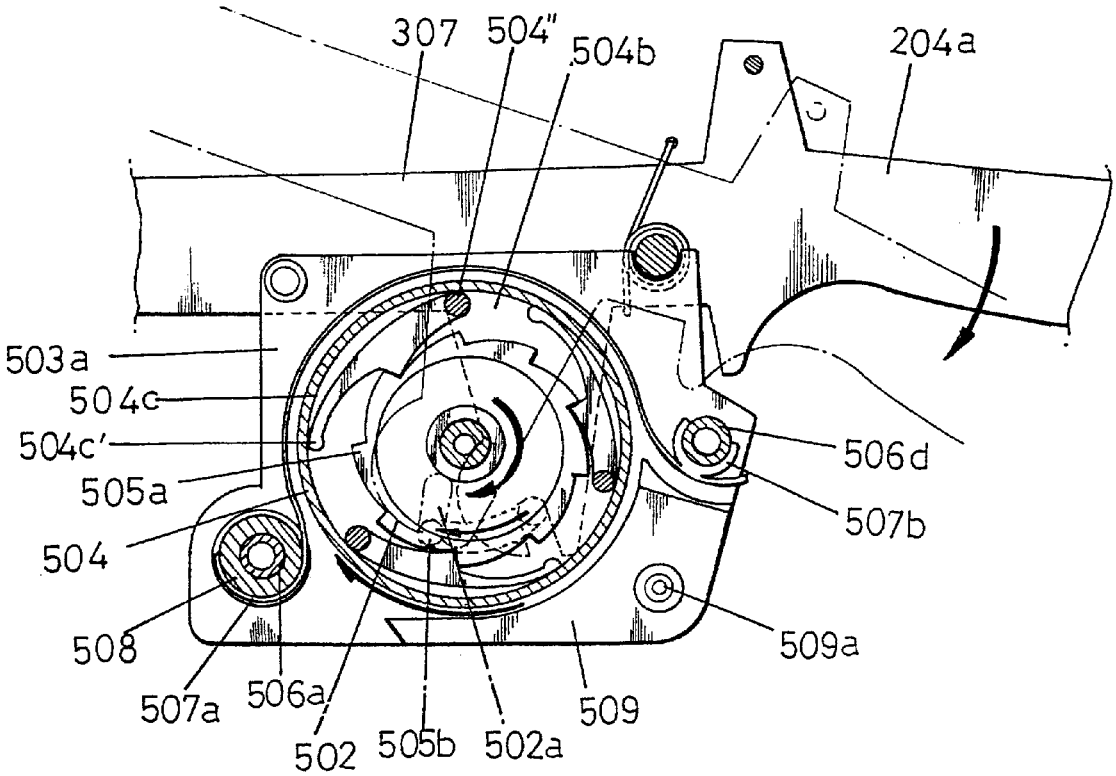
Figures 5, 6:
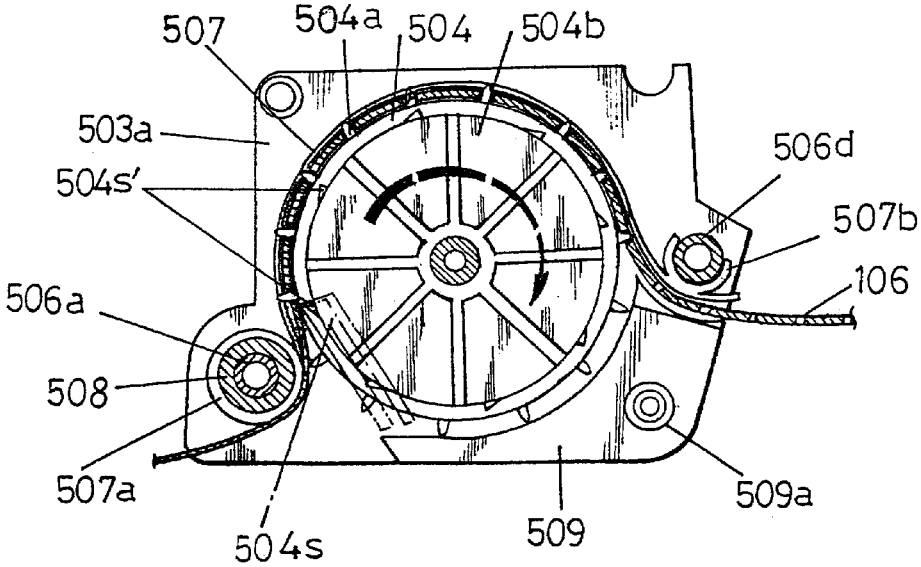
Figures 5, 6, 7:
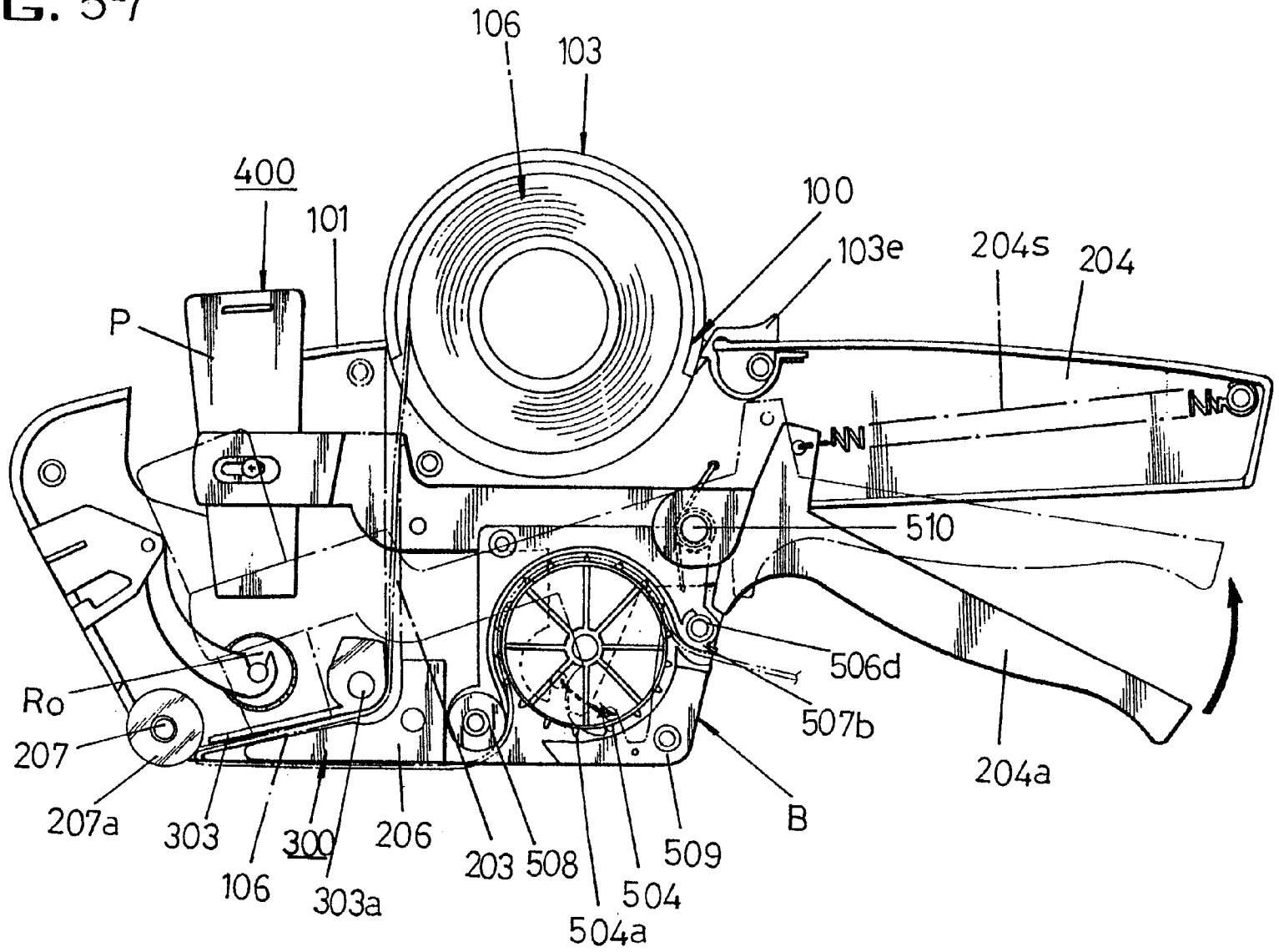

FIG. 5-1 is an exploded perspective view showing the tape carrying means 500 of the label stamper according to the present invention. FIG. 5-2 is an exploded perspective view of the tape carrying cartridge according to the present invention. FIG. 5-3 is a perspective view of the tape carrying cartridge. FIG. 5-4 is a longitudinal sectional view of the tape carrying cartridge. FIG. 5-5 is a side sectional view taken along a line A—A of FIG. 5-4. FIG. 5-6 is a side sectional view taken along a line B—B of FIG. 5-4. FIG. 5-7 illustrates the assembled state of the tape carrying cartridge according to the present invention.

As shown in FIG. 5-1, the label tape carrying means 500 includes an actuation mechanism A and a carrying cartridge B.

The actuation mechanism A includes a hand lever 204*a* movably secured to the main body 101 by means of a supporting shaft 501. An actuation lever 307 extends from a hand lever 204*a*. An actuation piece 502 extends vertically downward from the middle of the actuation lever 307. The actuation piece 502 is provided with a connection groove 502*a* which is connected to a crank shaft 505*b* of the cartridge.

In the place where the actuation piece is disposed, there is a space R for accommodating the cartridge. Into this space, there is assembled the cartridge B by means of fastening screws 510*a* and fastening holes 510.

The principal feature of the present invention in this respect is that the carrying roller is provided in the form of the cartridge.

As shown in FIG. 5-2, the tape carrying cartridge B is constituted as follows. That is, between two side plates 503*a* and 503*b* of a cartridge case 503, there are installed a carrying roller 504 having a plurality of teeth 504*a* and a ratchet wheel 505 by means a supporting shaft 506 and shaft holes 505*a*'. In a recess 504*b* of the carrying roller 504, there are formed a plurality of shaft holes 504' in which ratchet poles 504*c* are inserted, the ratchet poles 504*c* forming a circular contour.

Free ends 504*c*' of the ratchet poles 504*c* are contacted to a ratchet gear 505*a* of the ratchet wheel 505. Thus only when the ratchet wheel rotates in one direction, the carrying roller 504 revolves, while when the ratchet wheel 505 is rotated in the opposite direction, the carrying roller 504 maintains a stationary state. A crank shaft 505*b* of the ratchet wheel 505 is inserted into an elongate arcuate slot 503*c* of the side plate 503*a* of the cartridge to be exposed to the outside. Thus this crank shaft 505*b* is connected to a connection piece 502 of the actuation piece 502 shown in FIG. 5-1. Therefore when the actuation piece 502 actuates to the left and right in accordance with the actuation of the actuation lever 307 as a result of the manipulation of the hand lever 204*a*, the ratchet wheel 505 is rotated clockwise or anticlockwise owing to the actuation of the crank shaft 505*b*. However, the carrying roller 504 is interlocked to one direction rotation of the ratchet wheel 505.

Beneath the cartridge, a guide roller 508 is installed by means of a supporting shaft 506*a* and a shaft hole 508*a*. Both ends of the supporting shaft 506*a* are coupled to fastening holes 506*a*' of the side plates 503*a* and 503*b* by means of fastening screws 510*a*. The guide roller 508 plays the role of guiding the label tape 106 to the carrying roller 504.

Above the carrying roller 504, there are installed tape push plates 507 by means of coupling portions 507*a* and 507*b* and the supporting shafts 506*a* and 506*b*. The tape 106 which is guided by the guide roller 508 and the tape push plates 507 is engaged with the teeth 504*a* of the carrying roller 504. Therefore, in accordance with the rotation of the carrying roller, the tape 106 is pulled to be carried. When the tape is carried, the stamped labels are carried to the attaching roller 207 to be attached onto commodities.

Further, beneath the carrying roller 504, there is installed a directing plate 509 on the side plates 503*a* and 503*b* of the cartridge by means of the supporting shaft 506*c* and the shaft hole 509*a*, for directing the tape 106 to the outside.

The supporting shaft 506*c* is inserted into a hole 506*c*' of the side plate 503*b*, and is fastened by means of screws (not shown in the drawing). Supporting rods 506*d* are inserted into holes 506*d*' of the side plate 503*b*, and are fastened by means of screws (not shown in the drawing).

Thus the carrying roller is provided in the form of a cartridge, and the cartridge B is inserted into the cartridge loading compartment R of the main body 101 so as to be fastened by means of screws (not shown in the drawing) and fastening holes 510 as shown in FIG. 5-7. The cartridge B can be replaced by loosening the screws.

As shown in FIG. 5-7, the label stamper according to the present invention can be operated as follows. That is, if the handle 204 and the hand lever 204*a* are held by hand, and if the two are pressed together like when manipulating a scissor, then the actuation lever 307 moves downward. As a result, ink is spread on the relevant character block of the stamping belt 403 by the ink roller Ro, and the price is stamped on the label 106*a* which is held between the push plate 303 and the base plate 206. Then if the grasped hand lever 204*a* is released, then the hand lever 204*a* is spread owing to the elastic restoring force of the torsion spring 204*s*. At the same time, the actuation lever 307 moves upward. Thus the stamping device P is restored to the original position. Under this condition, the actuation piece 502 moves to the left and right, so that the crank shaft 505*b* of the carrying cartridge would be rotated clockwise and counter clockwise.

Accordingly, the ratchet wheel 505 is rotated, with the result that the carrying roller 504 revolves as much as the rotated angle of the ratchet wheel 505. Owing to the rotation of the carrying roller 504, the tape which is partly wound on the carrying roller is carried. The carrying distance is equal to the width of a label 106*a* which is attached on the tape. When the ratchet wheel 505 is restored, the reverse revolutions are prevented owing to a stopper 504*s* of the side plate 503*b* and an engaging step 504*s*'. Therefore, the carrying roller is driven only in one direction. Thus the labels which are repeatedly stamped are carried to the attaching roller 207 so as to be attached onto commodities by being pressed onto the commodities. The stamped labels are attached on the tape, but owing to the sharp triangular edge of the base plate 206, the tape is bent at that point, so that the labels would be detached from the tape. The tape plays the role of a conveyor for the labels, and this is a known feature.

The tape loading means 100, the tape guide means 200, the label tape holding means 300, the label stamping means 400 and the tape carrying means 500 in the label stamper according to the present invention have novel features compared with the conventional ones. Thus the loading case is made to project to the outside of the main body, so that the tape can be loaded in a speedy and simple manner.

Further, a side of the guide channel is open, and therefore, the tape can be easily inserted into the guide channel. Further, the tape guiding distance is short.

The tape holding means presses the tape onto the base plate in an automatic manner owing to the up and down movements of the loading case. Therefore additional devices are not needed unlike the conventional ones. Therefore, an attention is not required to the pressing of the tape onto the base plate.

The selecting hole of the selecting wheel of the stamping means is provided with recesses and triangular protuberances. Therefore, owing to the triangular protuberances, the fingers of the selecting bar are coupled to only one selecting wheel in an accurate manner. Therefore unlike the conventional ones, the relevant character blocks can be accurately selected and arranged.

Particularly, the tape carrying means is provided in the form of a cartridge. Therefore the manufacturing cost for the label stamper can be reduced in carrying out its mass production. Further, if the carrying roller is damaged during the use, it can be replaced in a simple manner, and therefore, the label stamper can be conveniently used even in a crowded store.

I claim:

1. A label stamper for stamping commodity prices, comprising:

a main body;

a tape loading means having a pair of folding and extending legs for supporting a loading case folding into and extending out of said main body to allow loading of a label tape;

a guide means having a front plate and a rear plate fastened to said main body forming a guide channel, a side of said guide channel being open to receive the tape;

a holding means having a base plate, a push plate biased to press-hold the tape to said base plate during stamping and a movable lever for contacting said push plate to release said tape during loading;

a stamping means having a stamping belt with selectable characters, a plurality of selecting wheels for selecting said characters and a selecting bar having a finger for engaging a recess and a triangular protuberance of a selecting hole of one of said selecting wheels for driving said stamping belt; and a carrying means in the form of a cartridge for replaceable attachment to said main body having a carrying roller for engaging the tape and a ratchet wheel for rotating said roller in one direction.

2. The label stamper as claimed in claim 1, wherein said pair of folding and extending legs cooperate with torsion springs and support shafts to make said loading case displaceable between a first position wherein said loading case is received in a loading compartment of said main body and a second position wherein said loading case protrudes outside of said main body.

3. The label stamper as claimed in claim 2, wherein one side of said loading case is closed; another side of said loading case is open; a supporting shaft is formed at a middle position of said loading case to receive said label tape; a cover is formed above said loading case; an engaging step is formed on an end of said cover; and a locking step is formed on a locking lever to be coupled with said engaging step.

4. The label stamper as claimed in claim 2, wherein said folding and extending legs for supporting said loading case are provided with teeth respectively on upper and lower portions thereof so that said pair of legs are folded and extended at the same angle while raising or lowering said loading case.

5. The label stamper as claimed in claim 1, wherein said label tape guide means includes a side plate divided into said front plate and said rear plate leaving a gap, said gap forming said guide channel having said opening on one side to make it easy to insert tape into said guide channel.

6. The label stamper as claimed in claim 5, wherein a lateral guide plate is formed on a front portion of said rear plate.

7. The label stamper as claimed in claim 1, wherein said push plate is supported above said base plate by a support shaft connected to a side plate and biased by a coil spring; and wherein said movable lever further includes an interlocking lever positioned above said push plate and an actuation lever, said actuation lever contacting said interlocking lever so as to actuate said push plate to release said tape during loading.

8. The label stamper as claimed in claim 7, wherein a protuberance of said actuation lever contacts with a cam portion of said interlocking lever to actuate said actuation lever so as to make a roller of said interlocking lever press the label tape onto said guide plate, thereby preventing an excessive loosening of the tape.

9. The label stamper as claimed in claim 8, wherein a connection bar is connected to an upper portion of said interlocking lever and said lower portions of said legs such that said interlocking lever departs from contacting said push plate, thereby making said push plate press the tape onto said base plate when said loading case is in said loading compartment of said main body.

10. The label stamper as claimed in claim 7, further comprising a crank shaft attached to said ratchet wheel; and an actuation piece extending from said actuation lever having a connection groove for engaging said crank shaft to drive said ratchet wheel and said carrying roller through manipulation of said lever.

11. The label stamper as claimed in claim 1, wherein said plurality of selecting wheels is installed between a pair of side plates by means of a guide rod and a retaining plate;

said stamping belt wound around said selecting wheels and said stamping wheel; and a slider coupled to said selecting bar and extending through a guide plate, said selecting bar being shiftably inserted into said selecting hole of said selecting wheels for adjusting said stamping belt so as to select and arrange character blocks.

12. The label stamper as claimed in claim 11, wherein said selecting hole of said selecting wheel is a polygonal-shaped hole; and said selecting bar includes a plurality of fingers each having a protuberance, said fingers inserted into said selecting hole and said protuberances engaging said furrows.

13. The label stamper as claimed in claim 1, wherein said label tape carrying means further includes push plates disposed above said carrying roller;

a guide roller for guiding the tape toward said carrying roller; and a guide plate for guiding the tape from said carrying roller.

14. The label stamper as claimed in claim 13, further comprising ratchet poles attached to and within a recess of said carrying wheel; and wherein said ratchet wheel includes a plurality of ratchet gears for engaging said ratchet poles to rotate said carrying roller in one direction.

15. The label stamper as claimed in claim 13, wherein said carrying roller includes a plurality of teeth; and wherein said push plates lightly press an upper circumferential surface of said carrying roller to mesh the tape with said teeth, thereby moving the tape without departing from said carrying roller.

16. The label stamper as claimed in claim 13, wherein said carrying roller includes an engaging step to be engaged with a stopper of a side plate so a to prevent reverse revolutions of said ratchet wheel.

17. The label stamper as claimed in claim 13, wherein said cartridge of said carrying means includes a pair of side plates; and wherein said crank shaft of said ratchet wheel passes through one of said side plates.

* * * * *